US008276249B2

(12) United States Patent
Willerscheid et al.

(10) Patent No.: US 8,276,249 B2
(45) Date of Patent: Oct. 2, 2012

(54) DEVICE AND METHOD FOR WIDENING METAL ELEMENTS

(75) Inventors: Heiner Willerscheid, Lauf (DE); Mario Gasperini, Gaggenau (DE); Bernd Spissinger, Baiersbronn (DE); Kilian Krettenauer, Gaggenau (DE)

(73) Assignee: Protektorwerk Florenz Maisch GmbH & Co. KG, Gaggenau (DE)

( * ) Notice: Subject to any disclaimer, the term of this patent is extended or adjusted under 35 U.S.C. 154(b) by 849 days.

(21) Appl. No.: 12/282,142

(22) PCT Filed: Feb. 28, 2007

(86) PCT No.: PCT/EP2007/001734

§ 371 (c)(1),
(2), (4) Date: Feb. 5, 2009

(87) PCT Pub. No.: WO2007/101594

PCT Pub. Date: Sep. 13, 2007

(65) Prior Publication Data

US 2010/0000284 A1 Jan. 7, 2010

(30) Foreign Application Priority Data

Mar. 8, 2006 (DE) ..... 10 2006 010 795

(51) Int. Cl.
*B21D 31/04* (2006.01)
*B21D 47/02* (2006.01)

(52) U.S. Cl. ..... 29/6.1; 29/890.043; 165/159; 165/162

(58) Field of Classification Search ..... 29/6.1, 29/890.03, 890.043; 165/159, 162, 172, 165/379.2, 459, 478; 298/68.1
See application file for complete search history.

(56) References Cited

U.S. PATENT DOCUMENTS 698,448 A 4/1902 Caldwell
1,231,888 A 7/1917 Herr
(Continued)

FOREIGN PATENT DOCUMENTS

DE 1 177 806 B 9/1964
(Continued)

OTHER PUBLICATIONS

English translation of the International Preliminary Report on Patentability (Chapter II of the Patent Cooperation Treaty) from the International Bureau of WIPO for International Application No. PCT/EP2007/001734 dated Oct. 30, 2008, 7 pages.

(Continued)

*Primary Examiner* — David B Jones
(74) *Attorney, Agent, or Firm* — Fitch Even Tabin & Flannery, LLP

(57) ABSTRACT

A device and a method for widening elongated metal elements which move in the longitudinal direction and are planar at least in certain regions are described. The device comprises at least two clamping sections which are opposite one another and of which one is arranged and designed for clamping a first longitudinal side of the metal element in place and the other is arranged and designed for clamping a second longitudinal side of the metal element in place, said second longitudinal side being opposite the first longitudinal side of the metal element. The clamping sections are each provided on a support unit by means of which the clamping sections, during the forward movement of the metal element, are automatically moved apart essentially perpendicularly to the direction of movement of the metal element.

29 Claims, 9 Drawing Sheets

U.S. PATENT DOCUMENTS

| | | | | |
|---|---|---|---|---|
| 2,191,433 | A | | 2/1940 | Manofsky |
| 2,988,772 | A | | 6/1961 | Horn |
| 3,256,558 | A | | 6/1966 | Andersen et al. |
| 3,514,352 | A | | 5/1970 | Judge, Jr. |
| 4,144,624 | A | | 3/1979 | Szego et al. |
| 4,291,443 | A | * | 9/1981 | Laurie et al. ..... 29/6.1 |
| 4,637,103 | A | | 1/1987 | Hutzenlaub |
| 4,807,336 | A | * | 2/1989 | Yoshimura et al. ..... 26/73 |
| 5,896,635 | A | * | 4/1999 | Marlow et al. ..... 29/6.1 |
| 6,212,744 | B1 | | 4/2001 | Inanobe et al. |
| 7,976,588 | B2 | * | 7/2011 | Fujiwara et al. ..... 29/623.1 |
| 8,039,153 | B2 | * | 10/2011 | Fujiwara et al. ..... 429/242 |
| 2006/0246312 | A1 | | 11/2006 | Krettenauer |

FOREIGN PATENT DOCUMENTS

| | | | |
|---|---|---|---|
| DE | 1 504 242 | A1 | 7/1969 |
| DE | 35 03 909 | C1 | 1/1986 |
| DE | 41 43 035 | A1 | 7/1993 |
| DE | 102 59 307 | A1 | 7/2004 |
| DE | 698 21 424 | T2 | 1/2005 |
| RU | 2 187 402 | C1 | 8/2002 |
| SU | 1581427 | A1 | 7/1990 |
| SU | 1618485 | A1 | 1/1991 |

OTHER PUBLICATIONS

First page of the Decision on Grant Patent for Invention issued in counterpart Russian Application No. 2008139896/02(051570) dated Sep. 23, 2010 (1 page) and an English translation of the same (6 pages).

* cited by examiner

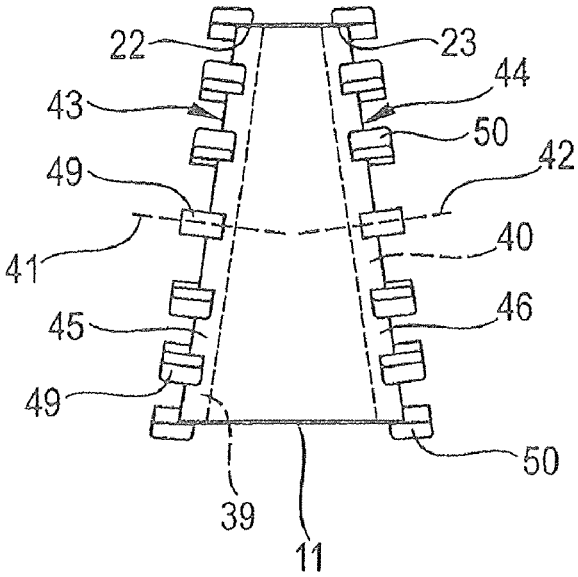
Fig. 13
Fig. 14
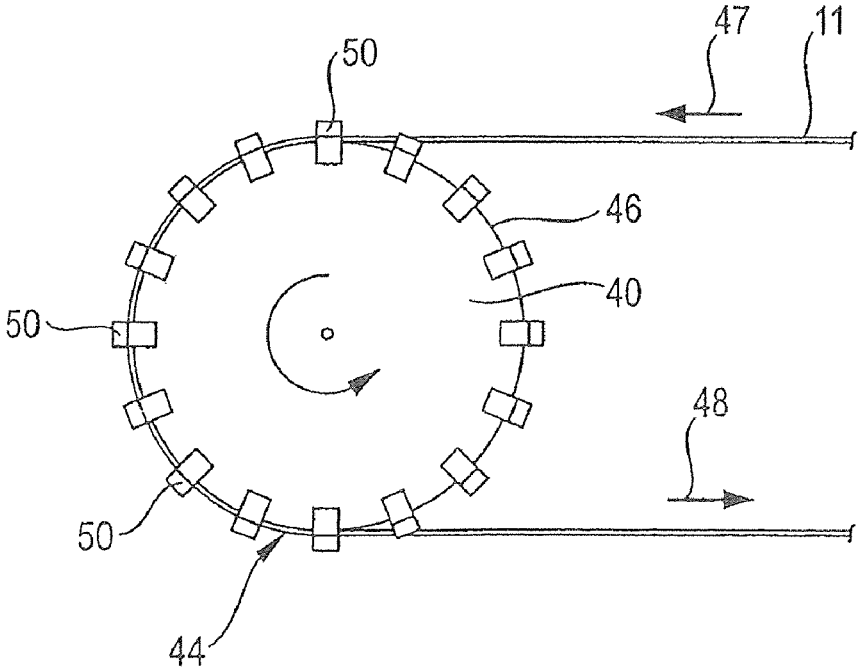

DEVICE AND METHOD FOR WIDENING METAL ELEMENTS

CROSS-REFERENCE TO RELATED APPLICATIONS

This application is a U.S. national phase application filed under 35 U.S.C. §371 of International Application PCT/EP2007/001734, filed on Feb. 28, 2007, designating the United States, which claims priority from DE 10 2006 010 795.0, filed Mar. 8, 2006, which are hereby incorporated herein by reference in their entirety.

FIELD OF THE INVENTION

The present invention relates to an apparatus and to a method for the expansion of elongated metal elements which move in the longitudinal direction and are areal at least regionally. In particular areal metal elements such as are described in German patent application 102 59 307.8 should be expanded using the apparatus and the method in accordance with the invention.

BACKGROUND OF THE INVENTION

The areal metal elements described in this prepublished German patent application are used, for example, for the manufacture of sectional elements, in particular of upright sections or plaster sections. The metal elements in this connection have incisions in their mid regions which are shaped such that, when the metal elements are drawn apart, metal regions present between the incisions are folded over so that ultimately a widening of the metal element takes place. Wider metal elements can thus be produced with a reduced metal consumption by this folding procedure. The cutting patterns required for the folding procedure can be of the most varied type. A plurality of such different cutting patterns are described in German patent application 102 59 307.8 and are in particular shown in FIGS. 1-22 of this application. For the better understanding of the present application, the disclosure content of German patent application 102 59 307.8, in particular with respect to the specifically described and shown cutting patterns, are explicitly included and incorporated by reference in the content of the present application. The metal elements in the sense of the present invention are made areal or flat at least in the region of the cutting patterns. In other regions, for example also in the region of the longitudinal sides of the metal elements, the metal elements can also deviate from the areal or flat shape. Thickened regions, steps or bent over regions can in particular be formed at the longitudinal sides. The metal elements can thus e.g. already be preshaped as U-shaped sections or C-shaped sections.

It is, however, problematic to carry out the expansion of such elongated metal elements which are areal at least regionally with an economically justifiable effort and so to achieve an economically sensible manufacture of the sectional elements. Since the costs of such sectional elements are mainly determined by the material costs, a widening of the metal element is admittedly generally desired with a reduced material requirement, but the gains recorded by the material saving many not be cancelled out again by increased costs in the production of the sectional elements. An economically worthwhile manufacture is the more difficult in this connection since corresponding sectional elements represent a mass produced article of which thousands of kilometers are produced annually and which is produced at a very high speed (for example 100 to 150 m/min). An apparatus for the expansion of corresponding areal or flat metal elements must therefore be capable of ensuring a correspondingly high throughput with a simultaneous high reliability.

SUMMARY OF THE INVENTION

It is therefore an object of the invention to provide an apparatus and a method for the expansion of elongated metal elements which move in the longitudinal direction, which are areal or flat at least regionally and which ensure a large throughput with a simultaneously simple and reliable design. The apparatus and the method should in particular be usable in continuous operation.

This object is satisfied in accordance with the invention by an apparatus of the initially named kind which comprises at least two mutually oppositely disposed clamping portions of which one is arranged and configured for the holding by clamping of a first longitudinal side of the metal element and the other is arranged and configured for the holding by clamping of a second longitudinal side disposed opposite the first longitudinal side of the metal element, with the clamping portions each being provided at a carrier unit by which the clamping portions are moved apart automatically substantially perpendicular to the direction of movement of the metal element during the forward movement of the metal element. In the method in accordance with the invention, a first longitudinal side of the metal element is clamped in a holding manner into a first clamping portion and a second longitudinal side of the metal element is clamped in a holding manner into a second clamping portion disposed opposite the first clamping portion, with the clamping portions each being provided at a support unit by which the clamping portions are moved apart automatically substantially perpendicular to the direction of movement of the metal element during the forward movement of the metal element.

The mutually oppositely disposed clamping portions thus form an expansion region for the metal element between them in which the spacing between the mutually oppositely disposed clamping portions increases. The expansion of the metal element takes place in the expansion region by enlarging the lateral spacing between the mutually oppositely disposed clamping portions which each draw the mutually oppositely disposed longitudinal sides of the metal element apart.

The apparatus in accordance with the invention is very robust thanks to its simple design and thereby also suitable for a high throughput. It is furthermore achieved by the clamping portions that the expansion of the moving metal element can take place in continuous operation so that the required throughput is ensured. It is generally, however, also possible for the expansion to take place in intermittent operation, for example also in a progressive tool. It is thus not absolutely necessary in the sense of the present application for the metal element to move forward simultaneously with the expansion. The forward movement of the metal element in intermittent operation, for example, includes repeating stationary phases in which the expansion can take place. The expansion during a stationary phase in intermittent operation is thus also to be understood as an expansion during the forward movement in the sense of the present invention since the individual stationary phases also represent parts of the total forward movement of the metal element. With a correspondingly short length of the metal element, it can also be expanded simultaneously over its total length, i.e. in plate production. In this case, the forward movement includes the infeed, the stationary phase during which the metal element is expanded and the outfeed of the metal element.

A preworking of the longitudinal sides of the metal element is not necessary due to the use of clamping portions. The longitudinal sides of the metal element do not need to have any folds or other engagement elements into which, for example, drawing elements engage for the drawing apart of the metal element. The longitudinal sides can be made completely smooth due to the clamping in accordance with the invention of the longitudinal sides of the metal element, whereby the application possibilities of the expanded metal elements are very wide and complex pre-treatments of the metal element associated with additional costs for the production of engagement points can be dispensed with. The clamping portions can be made such that a free longitudinal strip of 0.5 to 5 mm (for example approximately 1, 1.5, 2 or 3 mm) is already sufficient at both longitudinal sides of the metal element to clamp them in each case into the clamping portions and to draw the metal element apart.

In accordance with an advantageous embodiment of the invention, the clamping portions each comprise a contact region and a clamping region, with the longitudinal sides of the metal element being able to be clamped between the contact region and the clamping region. The clamping region can advantageously be formed by an eccentric member. The formation of the clamping region by an eccentric member also makes the whole apparatus very robust and simultaneously simple since the eccentric member can be supported at a supporting section of the clamping portion such that the clamping force generated by the eccentric member automatically increases on the moving apart of the clamping portions. The higher the force acting on the metal element thus is on the moving apart, the more firmly the metal element is clamped in the clamping portion.

It is generally also possible for the clamping portion to be pre-tensioned with respect to the contact region by spring bias. Any possible suitable type of spring can be used, for example helical springs, gas compression springs or other springs. A hydraulic, pneumatic, electric, magnetic or other mechanical pre-tensioning of the clamping portion with respect to the contact region and any other suitable type of pre-tensioning are also generally conceivable. Such a pre-tensioning is also sensible in connection with an eccentric design of the clamping region when the eccentric member does not yet unfold the full clamping force by the pre-tensioning, for example on the gripping of the metal element. Due to the pre-tensioning, the eccentric member can automatically be brought so far into the clamping position that ultimately the holding of the metal element is achieved only on the basis of the clamping force.

In accordance with a further preferred embodiment of the invention, the clamping portions each comprise a plurality of clamping elements. The development of the expansion of the metal element can be set in a simple manner by the division of the clamping portions into a plurality of clamping elements.

In accordance with a further advantageous embodiment of the invention, a control section, in particular in the form of a cam track guide, is provided with which the clamping elements can be brought automatically from a release position into a clamping position on the movement of the metal element. In a similar manner, a further control section can be provided with which the clamping elements can automatically be brought back from the clamping position into the release position on the further movement of the metal element after the expansion of the metal element. After the release of the metal element, the clamping elements can remain in their release position or can again be brought into the clamping position, but without a metal element clamped in. It must only be ensured that the clamping elements are in the release position shortly before the clamping elements again come into contact with the metal element. Said release position can be achieved again by corresponding control sections.

In particular the control sections made for the movement of the clamping elements into the clamping position can be made so movable that different positions of the clamping elements can be compensated which are produced, for example, by different thicknesses of the metal elements or by a penetration of the metal elements into the clamping elements of different amounts. The control sections can, for example, be movably supported hydraulically or against a spring force.

The carrier unit is preferably made as a circulating carrier unit, in particular as an endless circulating carrier unit. It is ensured by the configuration of the carrier unit as a circulating carrier unit that a metal element of any desired length can be expanded using the apparatus in accordance with the invention.

In accordance with a further advantageous embodiment of the invention, at least two circulating carrier units are arranged at each longitudinal side of the metal element, with each longitudinal side of the metal element being respectively clamped between at least two carrier units. With a horizontally arranged metal element, each longitudinal side of the metal element can thus be clamped, for example, between a carrier unit arranged above the metal element and a carrier unit arranged beneath the metal element. The clamping portions can thus preferably be made integrally with the carrier unit in this case. Generally, however, a separate configuration of the clamping portions is also possible.

In accordance with a further preferred embodiment of the invention, at least one circulating carrier unit is arranged at each longitudinal side of the metal element, with each longitudinal side of the metal element being respectively clamped in the clamping portions provided at the circulating carrier units. In this case, the longitudinal sides of the metal element are thus not clamped between two different carrier units, but each longitudinal side is rather respectively clamped in clamping portions which are, for example, arranged extending at carrier units to the side of the metal elements along its longitudinal sides.

The carrier units are preferably made as a track conveyor. It can, for example, be made as a steel tread. Generally, a design as a band, as a belt or as another peripheral unit, in particular suitable for clamping, is also conceivable.

In accordance with a further advantageous embodiment, a run-in region is provided for the metal element in which the mutually oppositely disposed clamping portions have substantially a constant spacing from one another, with an expansion region adjoining the run-in region in which the spacing between the mutually oppositely disposed clamping portions increases. It is ensured by the constant spacing of the clamping portions in the run-in region that the metal element can first be securely gripped by the clamping portions without any other forces acting on the metal element, in particular in the lateral expansion direction. Only after the metal element has been securely gripped by the clamping portions after running through the run-in region does the expansion of the metal element take place in the expansion region by enlarging the lateral spacing between the mutually oppositely disposed clamping portions which each draw apart the oppositely disposed longitudinal sides of the metal element. The spacing of the mutually oppositely disposed clamping portions preferably increases substantially continuously in the expansion region so that a continuous strain on the metal element is ensured which results in a uniform expansion of the metal element.

In accordance with a further preferred embodiment of the invention, the carrier units are configured as rotating disks, tires or wheels inclined with respect to one another. The clamping portions can each be formed in the outer marginal region of the rotating disks, tires or wheels. With this embodiment, in particular the contact regions of the clamping portions can be formed by the peripheral surfaces of the rotating disks, tires or wheels.

In this embodiment, the expansion of the metal element takes place by the angular position of the rotating disks, tires or wheels in that the metal element is clamped tight by the clamping portions in the region of the marginal regions of the carrier units inclined toward one another, is drawn apart by the peripheral surfaces of the rotating carrier units running apart and is released by the clamping portions again before the maximum spacing between the mutually inclined rotating carrier units is exceeded.

Further advantageous embodiments of the invention are recited in the dependent claims.

BRIEF DESCRIPTION OF THE DRAWINGS

The invention will be described in more detail in the following with reference to embodiments and to the drawings:

FIG. 13 shows a front view of a further apparatus in accordance with the invention;

FIG. 14 shows a side view of the apparatus of FIG. 13;

DETAILED DESCRIPTION OF THE PREFERRED EMBODIMENTS

Figure 1:
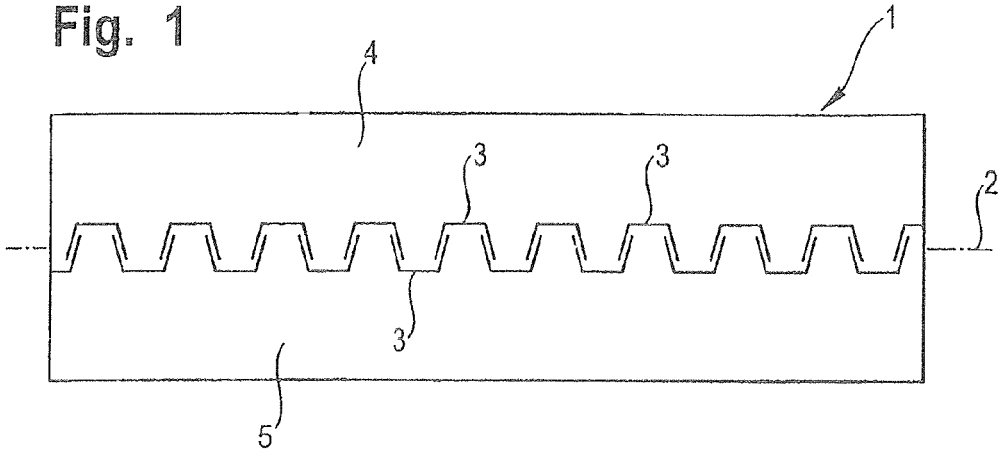
FIG. 1 shows a part of an areal or flat metal element with a cutting pattern.

FIG. 1 shows a section of an areal metal element 1 which is provided along its longitudinal axis 2 with a plurality of U-shaped sections 3 engaging into one another. The section shown in FIG. 1 is considerably shortened with respect to the actual length of the metal element 1. In actual fact, the metal element 1 forms a long metal strip which can have a length, for example, of several 100 m.

The metal element 1 is already described in the German patent application 102 59 307.8 to which reference is explicitly made.

The sections 3 are arranged such that the halves 4, 5 of the metal element 1 shown above or beneath the sections 3 in FIG. 1 can be drawn apart perpendicular to the longitudinal axis 2 so that a resulting metal element with enlarged width is produced. A corresponding folding procedure is shown in detail in FIGS. 3 to 5. Further possible cutting patterns are shown by way of example in FIG. 2.

Figure 6:
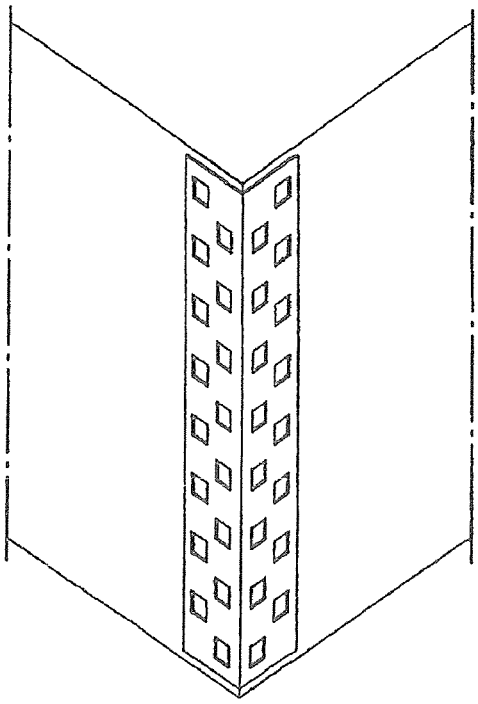
Figure 7:
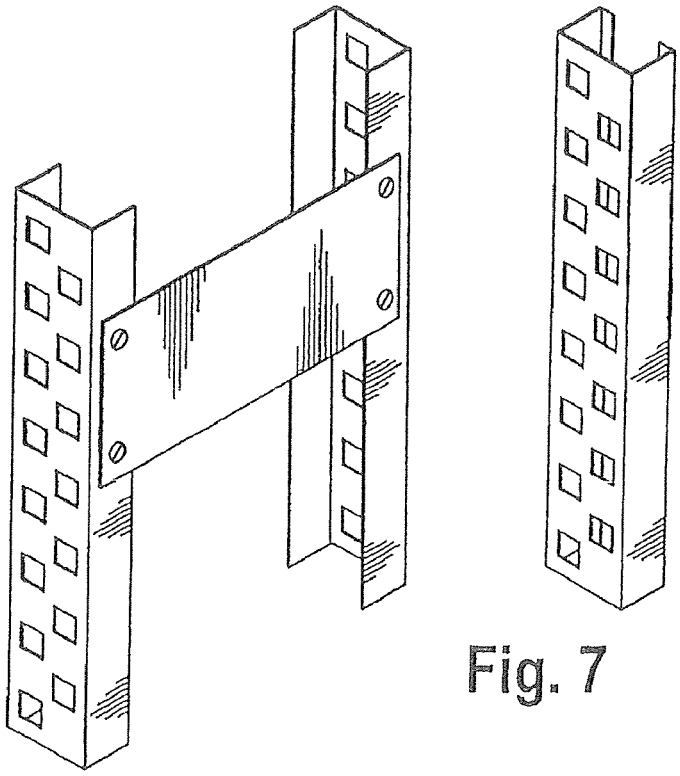
FIG. 7 shows U-shaped or C-shaped upright sections manufactured using an apparatus in accordance with the invention.

Correspondingly expanded metal elements can be used, for example, for the manufacture of sections such as are used e.g. as edge protection (FIG. 6) or as upright sections for dry walls (FIG. 7), e.g. in the form of U-sections and C-sections.

Figure 4:
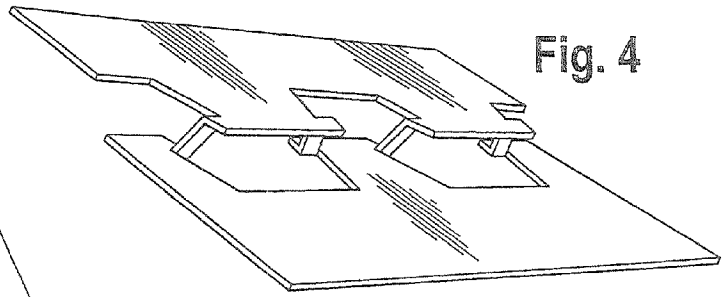
FIGS. 3 to 5 show three different states in the expansion of a metal element with the FIG. 6 shows an edge protector section manufactured using an apparatus in accordance with the invention.
Figure 5:
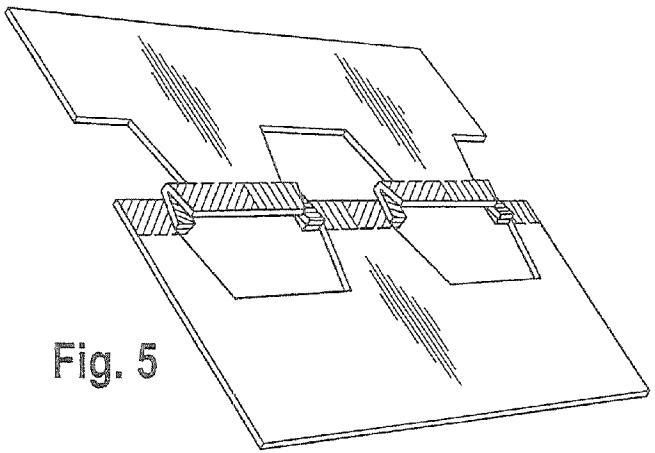
Figure 3:
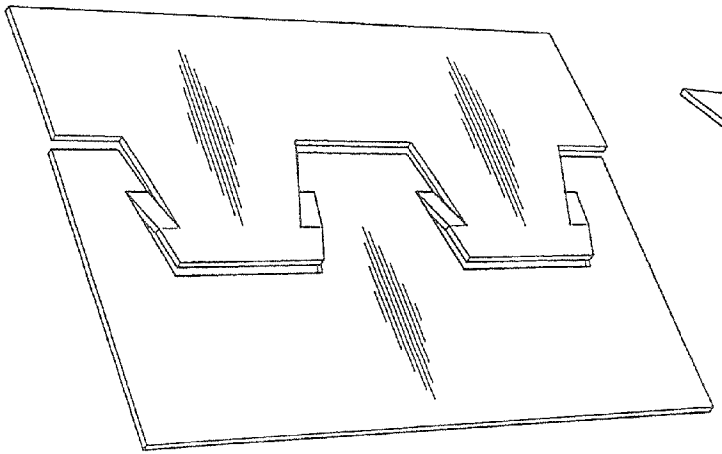
Figure 8:
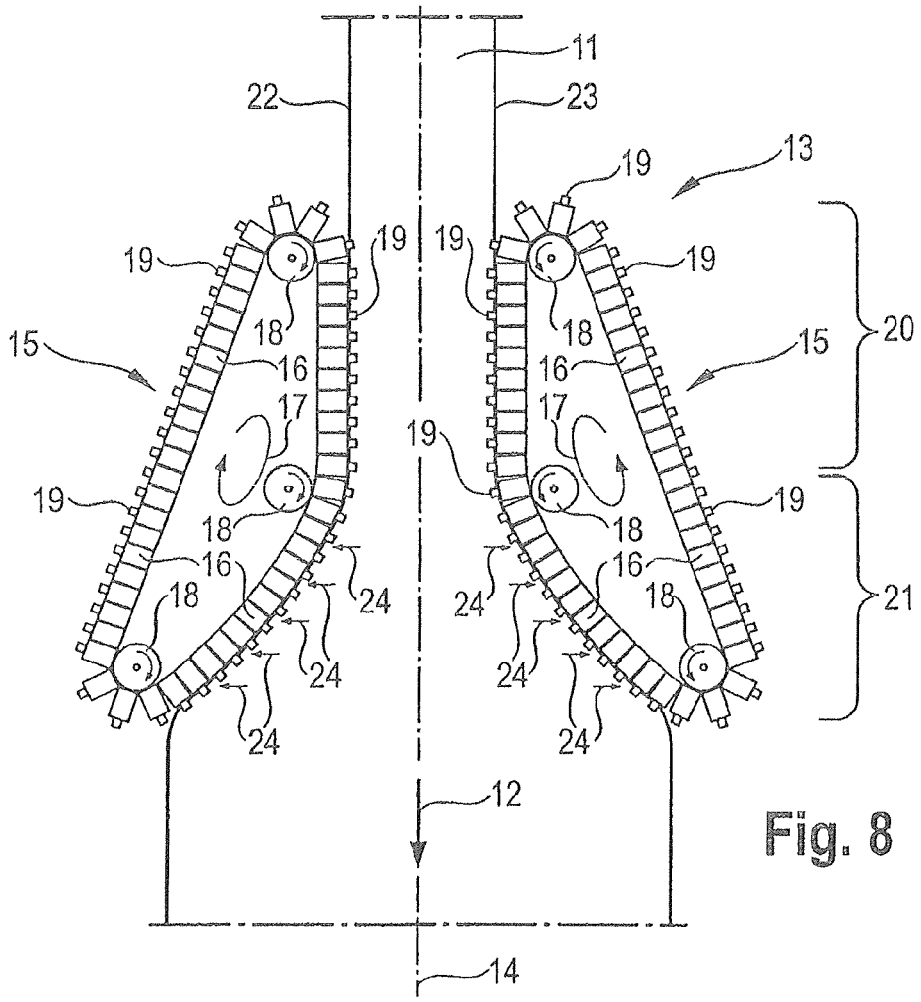
FIG. 8 shows a plan view of a first embodiment of an apparatus in accordance with the invention; cutting pattern of FIG. 1.

To be able to expand metal elements 1 known per se at high speed, as shown in FIGS. 3 to 5, an apparatus in accordance with FIG. 8 is, for example, used in accordance with the invention.

FIG. 8 shows an elongated areal or flat metal element 11 schematically which is moving along its longitudinal axis 14 in accordance with an arrow 12.

Figure 2:
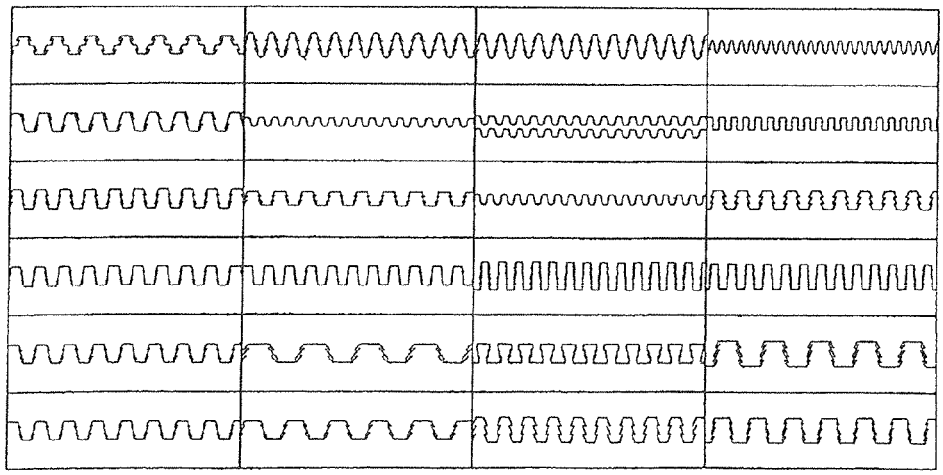
FIG. 2 shows further cutting patterns suitable for the expansion of metal elements.

The metal element 11 is provided with cuts in accordance with FIG. 1 or FIG. 2 or with other suitable cutting patterns which are, however, not shown in FIG. 8 or in the further Figures for reasons of clarity. In the upper region of FIG. 8, the metal element 11 has its original width as is present before the expansion.

The apparatus 13 shown in FIG. 8 for the expansion of the metal element 11 comprises two substantially identically made track conveyors 15 arranged symmetrically to the longitudinal axis 14 of the metal element 11. Each track conveyor 15 comprises a plurality of conveyor members 16 which are, for example, connected to one another via a chain not shown in FIG. 8.

The track conveyors 15 are made as endless track conveyors and are guided rotatably around deflection rollers 18 in accordance with arrows 17. Two or more deflection rollers can be provided in dependence on the design.

Generally, the deflection rollers 18 can be driven or only rotate freely around their respective axes.

Clamping elements 19 are in each case arranged at the outwardly facing sides of the conveyor members 16 and move in the arrow direction 17 together with the conveyor members 16. The track conveyors 15 thus form carrier units for the clamping elements 19, whereas the clamping elements 19 respectively provided at a track conveyor form a clamping portion of this track conveyor.

The two track conveyors 15 are arranged such that a run-in region 20 and an expansion region 21 adjoining it are formed. In the run-in region 20, respectively mutually oppositely disposed clamping elements 19 facing toward the longitudinal axis 14 of the metal element 11 have the same spacing from one another which corresponds approximately to the width of the metal elements 11 not yet expanded. In the expansion region 21, the spacing of mutually oppositely disposed clamping elements 19 enlarges continuously, as can be recognized from FIG. 8. The run-in region 20 is not necessarily required in this connection so that, for example, the middle deflection rollers 18 can each be dispensed with and the expansion region 21 extends over the total length of the track conveyors 15.

The metal element 11 shown in FIG. 8 is arranged between the two track conveyors 15 in the run-in region 20 such that the two longitudinal sides 22, 23 of the metal element 11 engage into the clamping elements 19 and are held by them.

In the expansion region 21, the metal element 11 is expanded by the clamping elements 19 moving apart in accordance with arrows 24 in a direction substantially perpendicular to the longitudinal axis 14 until it has the desired width at the discharge end of the expansion region 21. After the expansion has taken place, the metal element can, for example, be rolled or pressed flat in a rolling process, whereby it receives its final width and the folding points produced in the metal element on the expansion are leveled. Generally, this can also take place by an otherwise suitable pressing process (e.g. in a stroke press).

Both the holding tight of the longitudinal sides 22, 23 of the metal element at the start of the run-in region 20 and the release of the widened metal element at the end of the expansion region 21 is effected by control sections, not shown, which cause an automatic closing and opening of the clamping elements 19. Corresponding control sections, which bring the possibly closed clamping elements 19 into the release position so that the metal element can penetrate securely into the clamping elements 19 in the run-in region 20 and can be gripped by them, can also be provided before the start of the run-in region 20. For example, the corresponding control sections can be formed by cam track guides which are provided before and at the start of the run-in region 20 or at the end of the expansion region 21 and cooperate with the clamping elements 19 in a corresponding manner. Generally, the control could also take place, for example, by limit switches or in another suitable manner. If the run-in region 20 is omitted, the control sections at the inlet side can accordingly be provided at the inlet of the expansion region 21.

The track conveyors 15 form carrier units for the clamping elements 19 and effect a movement apart of the clamping elements 19 in the expansion region 21 due to their shape shown in FIG. 8, said movement apart in turn resulting in an expansion of the metal element 11. Possibly present conveyor chains or conveyor belts, to which the individual conveyor members are connected, preferably extend in the region above and/or beneath the clamping elements 19 (perpendicular with respect to the surface of the metal element 11). It is avoided in this manner that the metal element 11 is stretched in the longitudinal direction in the curved sections of the track conveyors 15.

Figure 9:
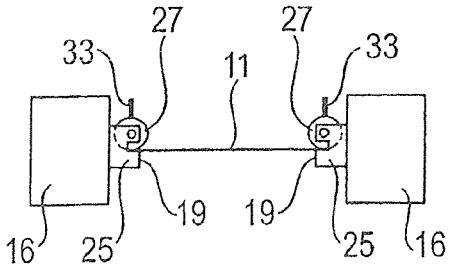
FIG. 9 shows a detailed view of the apparatus in accordance with FIG. 8 from the front.

A special embodiment of the clamping elements 19 is shown in more detail in FIG. 9. A clamping element 19 in accordance with FIG. 9 is shown again in detail in FIG. 10.

The clamping element 19 comprises a base element 25 which is fastened to the outer side of the conveyor member 16, as can be recognized from FIG. 9. The base element 25 has a U-shaped structure, with the inner side of the limb shown at the bottom in FIGS. 9 and 10 forming a contact region 26 for the metal element 11.

Figure 10:
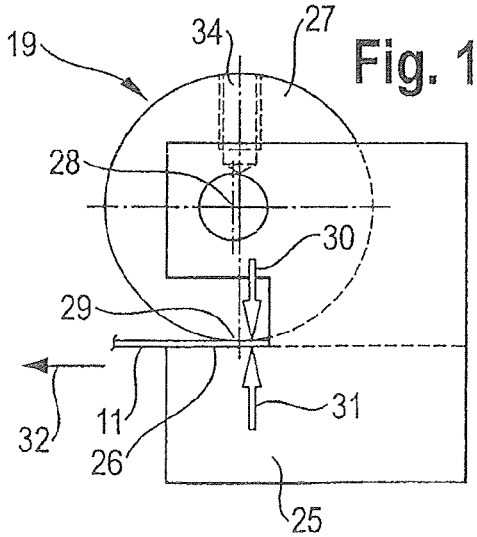
FIG. 10 shows a detailed view from FIG. 9.

Furthermore, the clamping element 19 comprises an eccentric member 27 which is rotatably supported around an axis 28 at the limb of the U-shaped base element 25 shown at the top in FIGS. 9 and 10. The eccentric member forms a clamping region 29 for the metal element 11 which is clamped between the contact region 26 and the clamping region 29, as can in particular be clearly recognized by two arrows 30, 31 from FIG. 10.

The eccentric member 27 is rotatably supported off-center around the axis 28 such that, on a rotation of the eccentric member counter-clockwise in accordance with FIG. 10, the clamping effect is canceled, whereas it is amplified on a rotation clockwise. On a tensile load of the metal element 11 in the direction of an arrow 32, the clamping effect is thus increased due to the friction in the clamping gap which is present so that the metal element 11 is automatically clamped more firmly on the tensile strain occurring in the expansion region 21. Generally, the clamping element 19 can also include a plurality of eccentric members 27 which are in particular arranged next to one another and which can, for example, be supported on the same axis.

As can be recognized from FIG. 9, a cam spigot 33 is provided at the upper side of the eccentric member 27 and is screwed, for example, into a threaded bore 34 (see FIG. 10). The control spigot 33 can, for example, cooperate with the track guidance described above such that the eccentric member 27 located at the start of the run-in region 20 in its non-clamping release position is automatically moved into the clamping position after one of the longitudinal sides 22, 23 of the metal element 11 is moved into the clamping region of the clamping element 19. In an analogous manner, the eccentric member 27 can be moved from its clamping position into the release position by a further cam track guide at the outlet of the expansion region 21 by a corresponding contact of the cam track guide with the control spigot 33 such that the clamped metal element 11 is released again.

By the use of an endless carrier unit with automatic clamping elements, the expansion apparatus in accordance with the invention is very simple and robust in design and can in particular expand metal elements moving at high speed from a first width to an enlarged second width.

Figure 11:
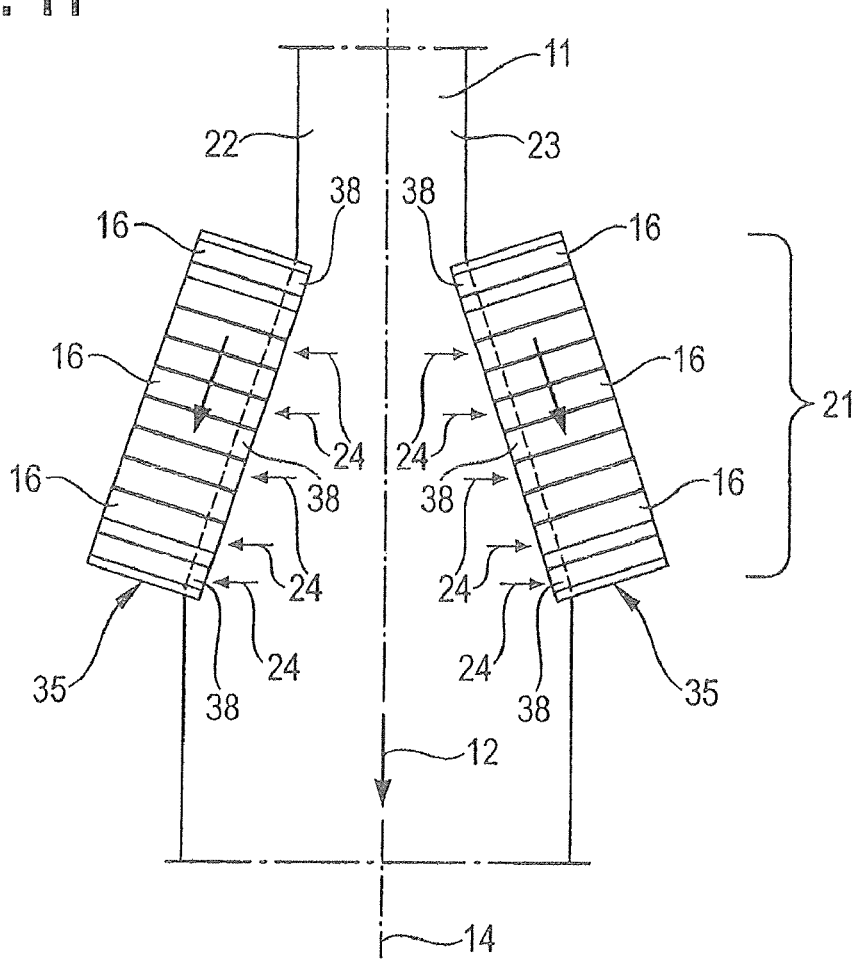
FIG. 11 shows a plan view of a second embodiment in accordance with the invention.
Figure 12:
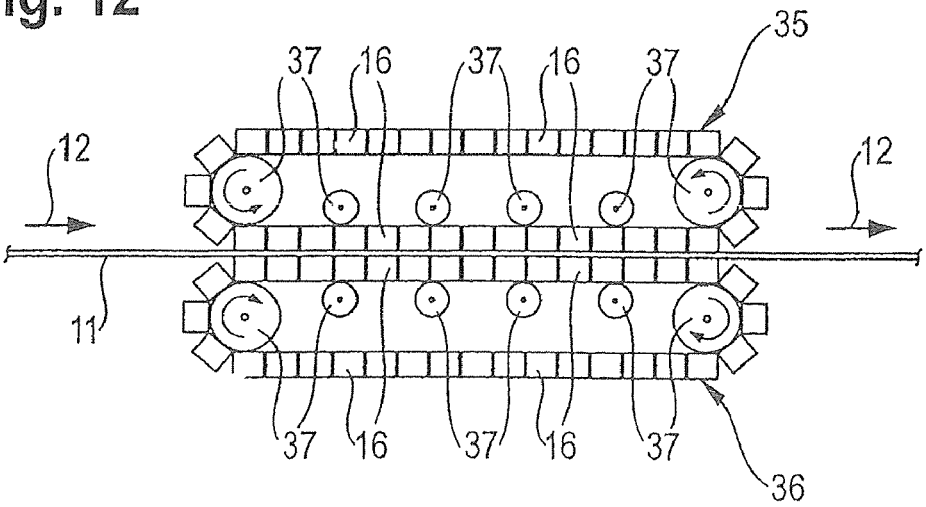
FIG. 12 shows a side view of the apparatus of FIG. 11.

A modified embodiment of the invention is described in FIGS. 11 and 12. Elements already described are shown with the same reference numerals which were already used in the description of the first embodiment in accordance with FIGS. 8 to 10.

In the embodiment in accordance with FIGS. 11 and 12, two track conveyors 35, 36, of which only the upper track conveyor 35 can be seen in each case in FIG. 11, are each arranged above one another at both longitudinal sides 22, 23 of the metal element 11. The track conveyors 35, 36 in turn have a plurality of conveying members 16 which are each connected to one another, for example via a conveyor chain which is not shown.

The conveyor members 16 are guided around horizontally arranged deflection rollers 37 which are either drivable or freely rotatable.

The longitudinal sides 22, 23 of the areal metal element 11 are each arranged between the upper and lower track conveyors 35, 36 which are arranged at both sides and which are arranged so close to one another that the longitudinal sides 22, 23 of the metal element 11 are clamped between the upper and lower track conveyors 35, 36. In this embodiment, the outer sides of the conveyor members 16 thus directly form clamping portions 38 for the metal element 11.

As can in particular be recognized from FIG. 11, the track conveyors 35, 36 arranged at both sides of the metal element 11 are arranged obliquely with respect to the longitudinal axis 14 so that an expansion region 21 is in turn formed. The spacing of respectively mutually oppositely disposed clamping portions 38 enlarges continuously within the expansion region 21 in the movement of direction of the metal element 11 shown by the arrow 12.

As in the embodiment in accordance with FIGS. 8 to 10, an expansion and widening of the metal 11 thus likewise takes place in the expansion region 21, as can be seen from FIG. 11.

The embodiment in accordance with FIGS. 13 and 14 in particular differs from the previously described embodiments in that the carrier units are not formed by track conveyors, but rather by two obliquely positioned disks 39, 40 symmetrical to one another. The disks 39, 40 are rotatably around axes of rotation 41, 42 correspondingly inclined with respect to one another and, in the representation shown in FIG. 13 have minimal spacing from one another at the upper region and maximal spacing from one another at the lower region.

The respective outer marginal regions of the disks 39, 40 are configured as clamping portions 43, 44, with the peripheral surfaces of the disks 39, 40 forming contact regions 45, 46 for the areal metal element 11.

The longitudinal sides 22, 23 of the metal element 11 contact the contact regions 45, 46 of the disks 39, 40 and said metal element is guided around the disks 39, 40 in accordance with arrows 47, 48.

The metal element 11 is pressed toward the contact regions 45, 46 via clamping elements 49, 50 provided at the marginal regions of the rotating disks 39, 40 and is thereby clamped tight between the clamping elements 49, 50 and the contact regions 45, 46.

Due to the mutually inclined arrangement of the rotating disks 39, 40 and to the expanding spacing of the edges of the rotating disks 39, 40 shown at the top in FIG. 13 to their lower edges which results therefrom, the clamped in metal element 11 is expanded on the rotation of the disks 39, 40, as can be seen from FIG. 13.

In a similar manner as with the previously described embodiments, the clamping elements 49, 50 can be adjusted automatically via cam track guides from their release position into the clamping position and back. Corresponding cam track guides can, for example, be provided between the metal element 11 and the rotating disks 39, 40 in the region of the starting contact points and end contact points disposed at the top and at the bottom respectively in FIGS. 13 and 14.

Figure 15:
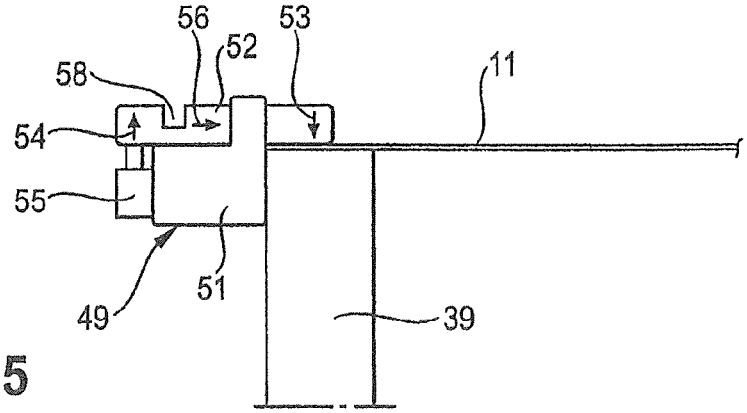
FIG. 15 shows a clamping element of the apparatus in accordance with FIG. 13.
Figure 16:
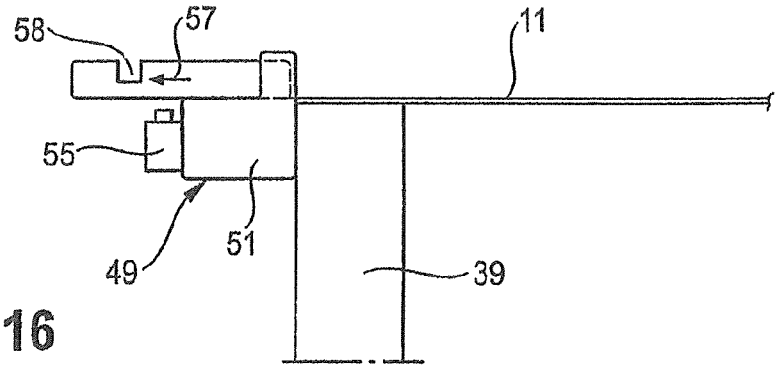
FIG. 16 shows the clamping element in accordance with FIG. 15 in the release position.

FIGS. 15 and 16 show a special aspect of the clamping elements 49, 50 schematically in a detailed view.

The clamping element 49 (as well as the clamping element 50 not described any further in the following) has a base part 51 which is fastened to the outer side of the rotating disk 39. A displaceably and pivotably supported clamping lever 52 is provided at the radially outwardly disposed side of the base part 51 and is located in the clamping position in FIG. 15 and in the release position in FIG. 16. In the clamping position shown in FIG. 15, the end of the clamping lever 52 disposed toward the disk 39 presses onto the metal element 11 guided around the disk 39 and clamps it between the disk 39 and the clamping lever 52.

The clamping lever 52 is pressed upwardly in accordance with an arrow 54 in FIG. 15 at its end remote from the disk 39 so that its oppositely disposed end is pivoted downwardly in accordance with an arrow 53, whereby the described clamping effect is achieved. The action on the clamping lever 52 at its end remote from the disk 39 can take place, for example, via a gas compression spring 55.

The clamping lever 52 is furthermore displaceably supported in accordance with two arrows 56, 57, with the displacement being able to take place, for example, by a cam track guide which engages into a groove 76 provided at the upper side of the clamping lever 52. On a displacement of the clamping lever 52 into the release position in accordance with FIG. 16, the gas compression spring 55 can also be downwardly displaced by a corresponding cam track guide so that the clamping lever 52 is freely displaceable.

Figure 17:
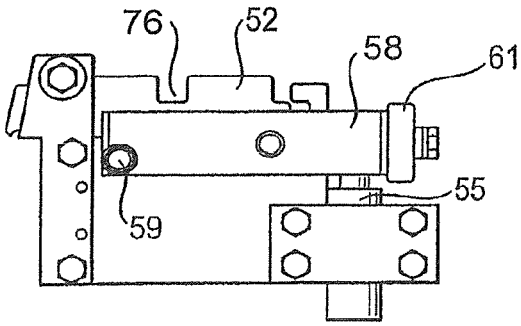
FIG. 17 shows a further detailed representation of a clamping element.
Figure 18:
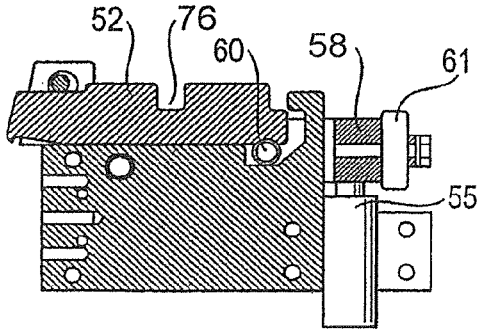
FIG. 18 shows a sectional representation through the clamping element in accordance with FIG. 17.

A specific aspect of the clamping element 49 is shown again in detail in FIGS. 17 and 18. It can be seen from these Figures that the clamping lever 52 can be tilted, for example via an intermediate lever 58, which is pivotable around an axis 59. On a pivoting of the intermediate lever 58 by the gas compression spring 55 upwardly around the axis 59, the clamping lever 52 is likewise pivoted upwardly via a bolt 60 provided at the intermediate lever 58.

If, in contrast, the intermediate lever 58 is pivoted downwardly against the gas compression spring 55 via a cam track guide engaging at its free end 61, the clamping lever 52 is released for a horizontal displacement which can be controlled via a cam track guide engaging into the groove 76.

Figure 19:
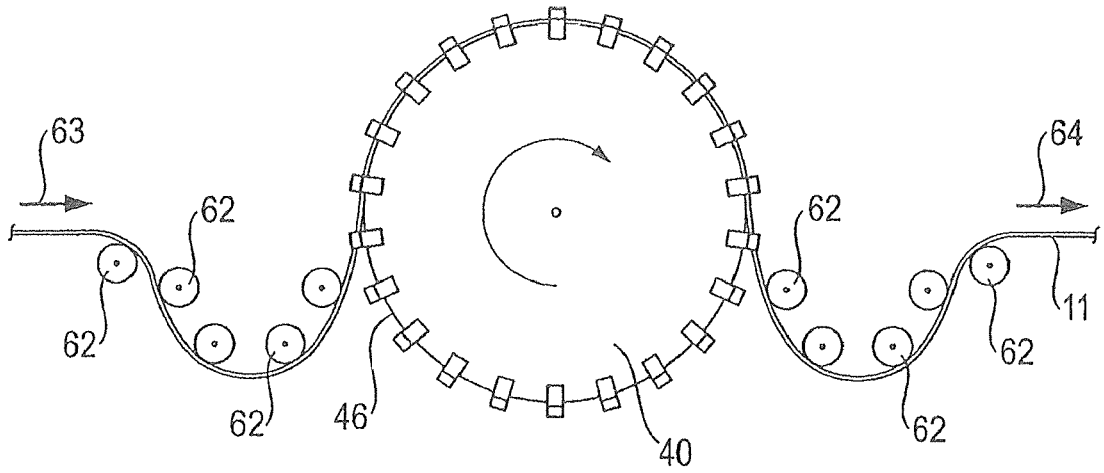
FIG. 19 shows a modification of the embodiment of the invention shown in FIGS. 13 and 14.

FIG. 19 shows a modification of the apparatus in accordance with FIGS. 13 and 14, wherein the metal element 11 runs in on one side of the obliquely positioned disks 39, 40 in accordance with arrows 63 64 and runs out again in substantially the same direction of movement on the oppositely disposed side. The disks 39, 40 are tilted toward one another in this case such that the spacing between the disks 39, 40 is minimal on the run-in side shown on the left in FIG. 19 and is maximal on the run-out side shown on the right to achieve the desired expansion.

To prevent a kinking of the metal element 11, it is guided in each case in a loop-like manner via guide pulleys 62 in the run-in and run-out regions so that the metal element 11 comes into contact with the peripheral surfaces of the disks 39, 40 forming the contact regions 45, 46 and also leaves them again substantially tangentially.

Figure 20:
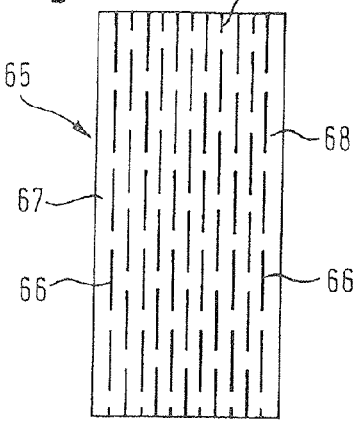
FIG. 20 shows a part of a further areal metal element with a cutting pattern.
Figure 21:
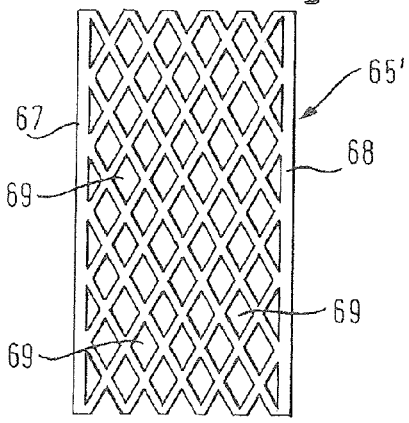
FIG. 21 shows the metal element in accordance with FIG. 20 after the expansion.

FIG. 20 shows a section from an areal metal element 65 which is provided with a plurality of parallel cuts 66 arranged alternatingly offset to one another. The longitudinal sides 67, 68 of the metal element 65 forming the marginal regions can be clamped using the apparatus in accordance with the invention and the metal element 65 can be drawn apart such that the elongated metal element 65' shown in FIG. 21 is produced. With a correspondingly tight arrangement of the clamping elements, expanded metal with expanded mesh 69, for example diamond-shaped mesh, can be manufactured, with the longitudinal sides 67, 68, however, forming straight outer edges, i.e. a closed structure. The stability of a correspondingly manufactured metal element 65' expanded in accordance with the invention is considerably improved with respect to conventional expanded metal due to the straight outer edges. The metal element 65' shown in FIG. 21 can be used, for example, for the manufacture of sections such as described with respect to FIGS. 6 and 7, or for other purposes as replacement for normal expanded metal.

Figure 22:
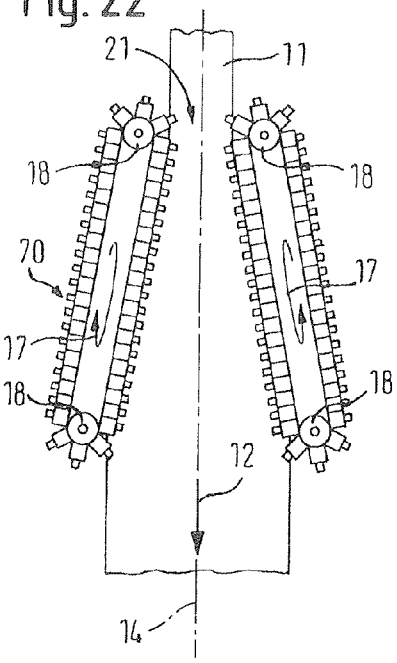
FIG. 22 shows a further apparatus in accordance with the invention.

FIG. 22 shows a track conveyor 70 which only differs from the track conveyor 14 of FIG. 8 in that no run-in region 20 is provided, but that rather the metal element 11 runs directly into the expansion region 21.

Figure 23:
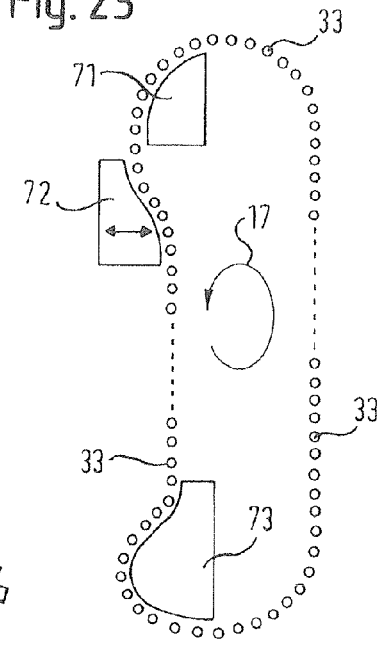
FIG. 23 shows a schematic detailed view of an apparatus in accordance with the invention.

FIG. 23 shows in a highly schematic manner three control sections 71, 72, 73 made as cam track guides by which the clamping elements 19 in accordance with the invention can be switched automatically between the release position and the clamping position. In this connection, instead of the clamping elements 19, only their cam spigots 33 are indicated in FIG. 23 which cooperate with the control sections 71, 72, 73. At the inlet at the top in FIG. 23, the cam spigots 33 are tilted radially outwardly (to the left in FIG. 23) by the control section 71, whereby the clamping elements 19 are automatically brought into their release position so that the metal element 11 running into the expansion region 21 can enter between the contact regions 26 and the clamping regions 29 of the clamping elements 19. After leaving the control section 71, the cam spigots 33 run toward the radially inwardly disposed cam surface of the second control section 72, whereby they are titled radially inwardly. The clamping elements 19 are automatically moved into the clamping position in this manner in which they clamp the longitudinal sides of the metal element 11. To compensate for irregularities in the thickness of the metal element 11 as well as tolerances in the clamping elements 19, the second control section 72 is supported movably along a double arrow 74 against pre-tensioning.

After the clamping elements 19 defined by the second control section 72 have been brought into their clamping position, the metal element 11 is drawn apart during the running through of the expansion region 21. At the end of the expansion region 21, the cam spigots 33 run toward the radially outwardly disposed cam surface of the third control section 73 by which they are again tilted radially outwardly so that the clamping elements 19 are moved into their release position and the metal element 11 is automatically released by the clamping elements 19. On the return to the start of the expansion region 21, the clamping elements 19 can be either in their release position or in the clamping position.

Figure 24:
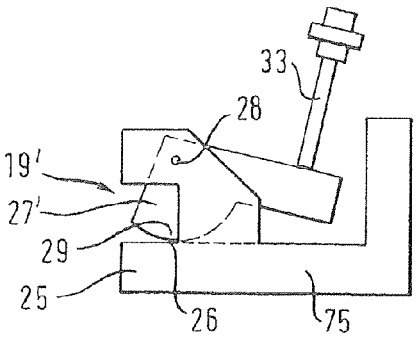
FIG. 24 shows a further embodiment of a clamping element made in accordance with the invention.

FIG. 24 shows a further embodiment of a clamping element 19' in accordance with the invention which substantially only differs from the clamping element 19 in accordance with FIG. 10 in that the eccentric member 27' has a circular shape only partly at its outer surface by which the clamping region 29 is formed. Furthermore, the U-shaped base element 25 is, unlike the clamping element 19, in each case fastened via an intermediate element 75 to the conveying member 16 (see FIG. 9) which can in particular be made in one piece with the base element 25.

The invention claimed is:

1. An apparatus for expanding an elongated, substantially flat metal element, the apparatus comprising:

carrier units arranged to support the elongated metal element for being advanced longitudinally in a forward direction with the carrier units being spaced from each other across the elongated metal element in a lateral direction transverse to the longitudinal, forward direction;

holding portions associated with the carrier units configured for holding the elongated metal element at either side thereof with the carrier units being further arranged so that laterally opposite ones of the holding portions move laterally apart from each other as the laterally opposite holding portions are advanced in the longitudinal, forward direction for laterally expanding the elongated metal element; and clamping portions of each of the holding portions including a clamp member and a clamp support each having a clamping surface, the clamping surfaces being arranged and configured to be shifted relative to each other between an open position with the clamping surfaces spaced from each other to allow the substantially flat, elongated metal element to be shifted relative to the clamping surfaces, and a closed position with the clamping surfaces spaced from each other by a clamping distance sized so that the elongated, substantially flat metal element is clamped between the clamping surfaces.

2. An apparatus in accordance with claim 1, characterized in that the clamping portions each include a contact region and a clamping region and the longitudinal sides of the metal element can be clamped between the contact region and the clamping region.

3. An apparatus in accordance with claim 2, characterized in that the clamping region is formed by an eccentric member.

4. An apparatus in accordance with claim 3, characterized in that the eccentric member is supported at a support section of the clamping portion such that the clamping force generated by the eccentric member increases automatically on the moving apart of the clamping portions.

5. An apparatus in accordance with claim 2, characterized in that the clamping region can be pre-stressed by spring bias toward the contact region.

6. An apparatus in accordance with claim 1, characterized in that a control section, in the form of a cam track guide, is provided with which the clamp members are automatically shifted from the open position to the closed position as the elongated metal element is advanced longitudinally in the forward direction.

7. An apparatus in accordance with claim 6, characterized in that the control section is movably provided to compensate for different positions of the clamp members.

8. An apparatus in accordance with claim 1, characterized in that the carrier units each comprise a circulating carrier unit.

9. An apparatus in accordance with claim 1, characterized in that an expansion region is formed between the mutually oppositely disposed clamping portions in which the spacing between the mutually oppositely disposed clamping portions increases.

10. An apparatus in accordance with claim 9, characterized in that the spacing of the mutually oppositely disposed clamping portions increases substantially continuously in the expansion region.

11. An apparatus in accordance with claim 1, characterized in that a run-in region is provided for the metal element in which the mutually oppositely disposed clamping portions have substantially a constant spacing with respect to one another.

12. An apparatus in accordance with claim 11, characterized in that an expansion region is formed between the mutually oppositely disposed clamping portions in which the spacing between the mutually oppositely disposed clamping portions increases and in that the expansion region adjoins the run-in region.

13. An apparatus in accordance with claim 1, characterized in that the carrier units comprise track conveyors.

14. An apparatus in accordance with claim 1, characterized in that the carrier units comprise rotating disks, tires or wheels inclined with respect to one another.

15. An apparatus in accordance with claim 14, characterized in that the clamping portions are each formed in the outer marginal region of the rotating disks, tires or wheels.

16. An apparatus in accordance with claim 14, characterized in that the clamp support of the clamping portions are formed by the peripheral surfaces of the rotating disks, tires or wheels.

17. An apparatus in accordance with claim 1, characterized in that a downstream pressing or rolling apparatus is provided by which the expanded metal element is pressed or rolled flat.

18. An apparatus in accordance with claim 7, characterized in that the control section is movably supported hydraulically or against a spring force.

19. An apparatus in accordance with claim 6, characterized in that the control section is constructed so that having moved the clamp members into their clamping position, the clamp members are decoupled from the control section during the moving apart of the holding portions.

20. An apparatus in accordance with claim 1, characterized in that a control section in the form of a cam track guide, is provided with which the clamp member are automatically shifted from the closed position to the open position on the further movement of the metal element after the expansion of the metal element.

21. A method for expanding elongated, substantially flat metal elements comprising:

supporting opposite, longitudinal sides of the elongated substantially flat metal element for being transported in a forward direction by carrier units;

clamping opposite upper and lower flat surfaces of the elongated, substantially flat metal element at the longitudinal sides thereof between clamping surfaces of the carrier units; and arranging the opposed carrier units having the clamping surfaces thereof clamped at either longitudinal side of the elongated, substantially flat metal sheet to shift apart as the elongated metal element is transported in the forward direction thereby for expanding the elongated metal element in a direction transverse to the forward direction so that only the upper and lower surfaces of the elongated substantially flat metal element are gripped during the expansion thereof.

22. A method in accordance with claim 21, characterized in that the carrier units each include a contact region and a clamping region and the longitudinal sides of the metal element are clamped between the contact region and the clamping region.

23. A method in accordance with claim 22, characterized in that the longitudinal sides of the metal element are clamped between the contact region and an eccentric member forming the clamping region.

24. A method in accordance with claim 21, characterized in that the the carrier units each comprise a plurality of clamping elements; and in that the clamping elements are automatically brought from a release position into a clamping position by a control section in the form of a guide track.

25. A method in accordance with claim 24, characterized in that the carrier units each comprise a plurality of clamping elements; and in that the clamping elements are again automatically brought from the clamping position into the release position by a control in the form of a cam track guide, after expansion of the metal element on the further movement of the metal element.

26. A method in accordance with claim 23, characterized in that the clamping force generated by the eccentric member automatically increases on the moving apart of the carrier units.

27. A method in accordance with claim 24, characterized in that the control section is moved to compensate for different positions of the clamping elements.

28. A method in accordance with claim 27, characterized in that the control section is moved hydraulically or against a spring force.

29. A method in accordance with claim 24, characterized in that after the clamping elements have been brought into their clamping position they are decoupled from the control section, during the moving apart of the clamping portions.

* * * * *